US010563396B2

(12) United States Patent
Foerg

(10) Patent No.: US 10,563,396 B2
(45) Date of Patent: Feb. 18, 2020

(54) SEALING STRING FOR SEALING A JOINT BETWEEN COMPONENTS, AND METHOD FOR MANUFACTURING SAME

(71) Applicant: HILTI AKTIENGESELLSCHAFT, Schaan (LI)

(72) Inventor: Christian Foerg, Dillishausen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/301,788

(22) PCT Filed: May 15, 2017

(86) PCT No.: PCT/EP2017/061561

§ 371 (c)(1),
(2) Date: Nov. 15, 2018

(87) PCT Pub. No.: WO2017/207252

PCT Pub. Date: Dec. 7, 2017

(65) Prior Publication Data

US 2019/0153725 A1 May 23, 2019

(30) Foreign Application Priority Data

Jun. 2, 2016 (EP) ..... 16172564

(51) Int. Cl.
*E04B 1/68* (2006.01)
*E04B 1/94* (2006.01)

(52) U.S. Cl.
CPC ..... *E04B 1/948* (2013.01)

(58) Field of Classification Search
CPC ..... E04B 1/68; E04B 1/6803; E04B 1/6813; E04B 1/6812; E04B 1/948; E06B 1/62;
(Continued)

(56) References Cited

U.S. PATENT DOCUMENTS 2,686,747 A * 8/1954 Wurtz ..... C08J 9/06 156/78
4,112,623 A * 9/1978 McPherson ..... E06B 7/2312 428/122

(Continued)

FOREIGN PATENT DOCUMENTS

DE 44 36 280 4/1996
DE 297 02 985 U1 6/1997

(Continued)

OTHER PUBLICATIONS

International Search Report dated Jul. 12, 2017 in PCT/EP2017/061561.
Written Opinion dated Jul. 12, 2017 in PCT/EP2017/061561.

*Primary Examiner* — Chi Q Nguyen
(74) *Attorney, Agent, or Firm* — Grüneberg and Myers PLLC

(57) ABSTRACT

A sealing cord for sealing a joint between two building elements includes a sealing profile, lateral portions, and a fastener. The sealing profile has a compressible sealing material. The lateral portions extend from the sealing profile in several directions transversely relative to a longitudinal direction. The fastener is on an exposed side of each of the lateral portions. The exposed side of each of the lateral portions is coupled to the sealing profile to the two building elements.

16 Claims, 3 Drawing Sheets

(58) Field of Classification Search
CPC ..... E06B 2001/626; E06B 2001/628; B29D 99/0053; Y10T 428/233; B65G 69/008; Y10S 277/906
USPC ..... 52/309.5, 309.4, 656.9, DIG. 13, 173.2; 428/71; 277/650, 64
See application file for complete search history.

(56) References Cited

U.S. PATENT DOCUMENTS 4,126,966 A * 11/1978 Lobell ..... E06B 7/231 428/124
4,182,088 A * 1/1980 Ball ..... E06B 3/28 160/354
4,769,267 A * 9/1988 Hoyt ..... A47L 13/17 428/71
4,784,516 A * 11/1988 Cox ..... E01C 11/10 14/73.1
6,110,312 A * 8/2000 Arnold ..... B29D 99/0053 156/204
6,422,575 B1 * 7/2002 Czaplicki ..... B29C 44/184 264/45.2
6,491,468 B1 12/2002 Hagen
6,672,597 B1 * 1/2004 Irrgeher ..... E04B 1/6812 277/650
8,317,200 B2 * 11/2012 Deiss ..... E06B 1/62 277/312
8,365,495 B1 * 2/2013 Witherspoon ..... E04B 1/948 52/741.3
8,551,594 B2 * 10/2013 Deiss ..... E04B 1/6812 428/131
8,586,165 B2 * 11/2013 Allen ..... B29C 44/182 428/158
9,021,754 B2 * 5/2015 Wormann ..... E04B 1/6812 52/214
10,352,040 B1 * 7/2019 Preston ..... E04B 1/6801
2005/0268559 A1 * 12/2005 Ellingson ..... E06B 5/164 49/475.1
2011/0123801 A1 5/2011 Valenciano
2011/0144222 A1 6/2011 Sauttreau et al.
2012/0023846 A1 2/2012 Mattox et al.
2014/0259952 A1 * 9/2014 Sheehy ..... B60J 5/0418 49/475.1

FOREIGN PATENT DOCUMENTS

DE 20 2010 017 680 U1 6/2012
DE 20 2011 050 191 U1 10/2012

* cited by examiner

SEALING STRING FOR SEALING A JOINT BETWEEN COMPONENTS, AND METHOD FOR MANUFACTURING SAME

The application is a National Stage entry under § 371 of International Application No. PCT/EP2017/061561, filed on May 15, 2017, and claims priority to European Patent Application No. 16172564.3, filed on Jun. 2, 2016, the entire contents of which are hereby incorporated by reference.

TECHNICAL FIELD

The invention relates to measures for sealing joints between two building elements; especially building components, such as building ceilings, building walls, drywalls or the like.

TECHNICAL BACKGROUND

Building components are usually not set directly against one another but instead a joint is left in order to be able to absorb relative movements between the building components. In order to prevent the passage of fire gases or flames through these joints in the fire situation, these are usually sealed with a flexible material; which does not hinder a relative movement between the building components. Sealing may be undertaken with sealing strips, which consist entirely or partly of an intumescent material.

From DE publication 20 2010 017 680 U1, a fire-protection joint cord is known that comprises a core having a compound-forming carrier and an intumescent component. The joint cord is inserted into a joint between two building elements, in order to seal the joint.

From US publication 2012 023846 A1, a sealing element for insertion between two building elements is known, wherein the sealing element is constructed from a hollow tube of a first material and a core of a second material. The first material is a combustible foam, which becomes detached under the effect of fire, and the second material expands under the effect of fire, in order to fill the volume between the building elements.

Joint cords containing intumescent materials are also known from US publications 2011/0144222 A1 and 2011/0123801 A1.

Furthermore, DE publication 44 362 80 A1 discloses a multi-layer sealing element in roll form.

However, the foregoing sealing strips exhibit disadvantages during mounting and/or in the flexibility for absorption of relative movements. Furthermore, after insertion of the joint cords, still further sealing and/or fixation measures may have to be taken and/or the surface may still have to be smoothed, in order to make it visually esthetic.

It is the object of the present invention to provide, for sealing a joint between building elements, an improved sealing cord, which is able to absorb a large relative movement between the building elements and which seals the joint safely against smoke gas as well as against water and dust, without assistance of additional sealing substances.

DESCRIPTION OF THE INVENTION

These objects are achieved by the sealing cord for sealing joints between building elements, as well as by the arrangement of one or more sealing cords in a joint between building elements.

According to a first aspect, a sealing cord is provided for sealing a joint between two building elements, especially between two building components, comprising:

- a sealing profile having a compressible sealing material;
- strip-like lateral portions, which jut out from the sealing profile in several directions, transversely relative to a longitudinal direction;
- a fastening means, which respectively is provided on one side of the lateral portions jutting out from the sealing profile.

One idea of the foregoing sealing cord consists in forming it with a sealing profile, which is equipped with lateral portions in the form of flat fastening strips, which extend in longitudinal direction and do so flexibly along the sealing profile. By means of separate or cohesive flat fastening strips, the lateral portions may be disposed in such a way on the sealing profile that the sealing profile protrudes at least for the most part from a connecting length between the seam lines of the lateral portions or from the seam line. The lateral portions may be equipped with a fastening means respectively on the side on which the sealing profile protrudes. By virtue of the fastening means, the sealing cord can be inserted into a joint between two building elements and fixed on the rim regions of the building elements adjoining the joint. The lateral portions consist preferably of a film, especially a polyethylene film.

The sealing cord may be securely anchored in the joint by means of the lateral portions equipped with a fastening means. Since the profile is additionally held in position with the fastening means on the wing portions, the sealing strip must be lightly pressed into the joint.

Furthermore, it is not necessary to introduce an additional sealing substance. Thereby the mounting of the sealing cord is simpler and is possible without greater restriction even in cold weather.

Due to the provision of the flat sealing portions, a smoother joint surface that is visually esthetic can be achieved after introduction of the sealing cord. To improve the seal, several sealing cords may be joined to one another, in order to achieve multiplication of the thickness of the seal introduced into the joint.

It may be provided that the fastening means comprises an adhesive face. In particular, the adhesive face may be protected with a protective strip. Adhesive faces are particularly suitable as fastening means, since they are well suited for mounting of the sealing cord.

According to one embodiment, the sealing profile may be provided with a film tube filled with compressible foam material.

Furthermore, the sealing profile may have a round, oval or polygonal cross section. Any other types of cross section are also possible.

According to one embodiment, the sealing profile may be formed in chamber in a film tube.

Furthermore, the lateral portions may be formed by a fastening strip, on which the sealing profile is affixed along its longitudinal direction, especially on a middle portion, and from which the sealing profile juts out mainly in one direction.

According to one embodiment, the fastening means on the lateral portions jutting out from the sealing profile may be provided on the side of the jutting-out sealing profile. Thereby the overhang of the sealing cord after introduction into the joint can be reduced.

In particular, the sealing profile may be formed with a chamber, which is formed between a flat fastening film strip and a flat envelope film strip. This structure permits simple production of the sealing cord together with the sealing profile.

Furthermore, the envelope film strip may be fastened with its rims on rim regions of the fastening film strip, especially by welding or adhesive bonding, wherein the rim regions adjoin a bulging portion of the fastening film strips.

It may be provided that the bulging portion of the envelope film strip has a depth that is greater than the depth of the bulging portion of the fastening film strip.

According to a further aspect, an arrangement having a joint between two building elements and one or more of the foregoing sealing cords introduced therein, wherein the lateral portions are affixed on the rims of the building elements turned toward the joint, so that the sealing profile projects into the joint.

According to one embodiment, a first and a second sealing cord may be disposed alongside one another in such a way that they run in parallel with respect to their longitudinal directions, wherein the arrangement direction of the first and of the second sealing cord is substantially perpendicular to the extension direction of the fastening strip or to the extension of the fastening film strip.

BRIEF DESCRIPTION OF THE DRAWINGS

Embodiments will be explained in more detail hereinafter on the basis of the attached drawings, wherein.

DESCRIPTION OF THE EMBODIMENTS

Figure 1:
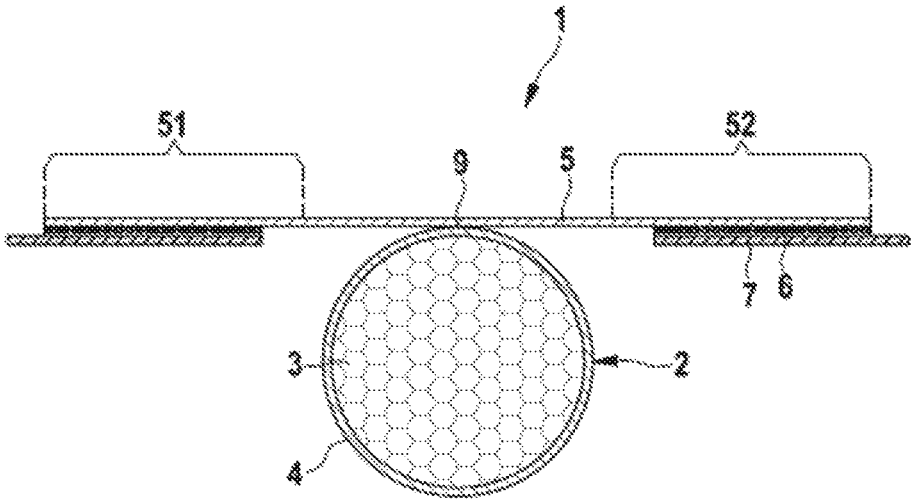
FIG. 1 shows a cross-sectional diagram through a sealing profile of a sealing cord according to a first embodiment.

FIG. 1 illustrates a cross-sectional diagram through a sealing cord 1. Sealing cord 1 is provided with a sealing profile 2 as a cross-sectional profile. Sealing profile 2 has a foam core 3, which contains a compressible foam material commonly used for sealing purposes. The foam material may be provided with a polyurethane foam and in particular have a density between 40 and 400 kg/m$^3$. Sealing profile 2 may have a round, oval or polygonal cross section and a diameter of between 0.5 and 20 cm, preferably of between 0.75 and 15 cm, more preferably of between 1 cm and 10 cm and most preferably of between 1 cm and 5 cm. The foam material may also be an open-cell or closed-cell foam material or a foam material on a silicone basis or else cellular rubber.

In particular, the sealing profile 2 may comprise a thin envelope, especially an elastic film tube 4 of a film material, which is filled with the foam material or the foam core. Sealing profile 2 may be produced by foaming film tube 4 containing the foam material.

Sealing profile 2 is disposed approximately in the middle on a flat fastening strip 5. For example, sealing profile 2 may be disposed on a fastening strip 5 at a fastening site 9 or a fastening region, especially by means of a weld seam, by adhesive bonding or the like. Fastening strip 5 may be formed from a film material or another material tape such as a tape of textile material or a material reinforced with mesh, screen or the like.

At lateral portions 51, 52 of fastening strip 5, a fastening means, in the form of an adhesive face 6, for example, may be provided on the side of sealing profile 2, in order to affix sealing cord 1 by adhesive bonding to rim regions of building elements surrounding a joint, especially two building components, such as walls, building ceilings or the like.

Adhesive face 6 may be covered with a protective strip 7, for example of silicone paper, which serves to protect adhesive face 6 prior to mounting and which is removed prior to introduction into the joint between two building components, in order to expose adhesive face 6.

For structural reinforcement, fastening strip 5 or at least the parts of lateral portions 51, 52 equipped with the fastening means may be equipped with a reinforcing structure, for example in the form of a screen inlay or the like, in order to further increase the stability of the lateral portions or of the entire fastening strip 5.

Figure 2:
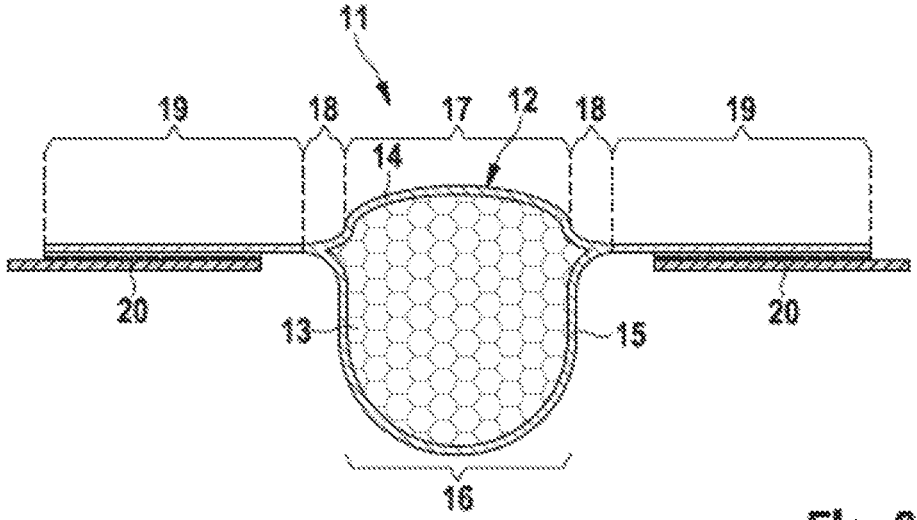
FIG. 2 shows a cross-sectional diagram through a sealing profile of a sealing cord according to a second embodiment.

As shown in FIG. 2, a sealing cord 11 may be formed with a sealing profile 12, wherein a chamber 13 is provided between a fastening film strip 14 and an envelope film strip 15, which are respectively formed with bulging portions 16, 17 of different sizes (cross sections) opposite one another, in order to form chamber 13. Envelope film strip 15 may be provided approximately at the middle with a first bulging portion 16, which is disposed opposite a second bulging portion 17 of fastening film strip 14. A rim region 18, on the outside of which a connecting portion 19 of fastening film strip 14 is respectively adjoined, is disposed off to the side of second bulging portion 17 of fastening film strip 14. Connecting portions 19 form the lateral portions for fastening sealing cord 11 to building elements. In particular, the rims of envelope film strip 15 may be affixed to rim regions 18 by adhesive bonding or welding, so that chamber 13 is formed.

Alternatively, fastening film strip 14 and envelope film strip 15 may overlap one another over the entire faces of rim regions 18 and of connecting portions 19 and be joined to one another, preferably by substance-to-substance bond, for example welded or adhesively bonded. In particular, sealing cord 11 is formed in such a way that the foam core formed in chamber 13 juts out on the side of envelope film strip 15 with a larger overhang than from the side of fastening film strip 14. In other words, first bulging portion 16 has a greater depth than second bulging portion 17.

In the embodiment of FIG. 2, connecting portions 19 of the fastening strip may likewise be equipped with a fastening means, e.g. in the form of an adhesive face 20, and with a protective strip, e.g. of silicone paper, which covers the adhesive face and protects adhesive face 20 until it is mounted in a joint.

For production of the sealing strip of FIG. 2, fastening film strip 15 is first placed in a recess, a liquid foam material is introduced and then envelope film strip 14 is welded on in such a way that chamber 13, in which the foam material introduced as liquid, foams and solidifies, is formed approximately in the middle of envelope film strip 14, between fastening film strip 15 and envelope film strip 14.

Figure 3:
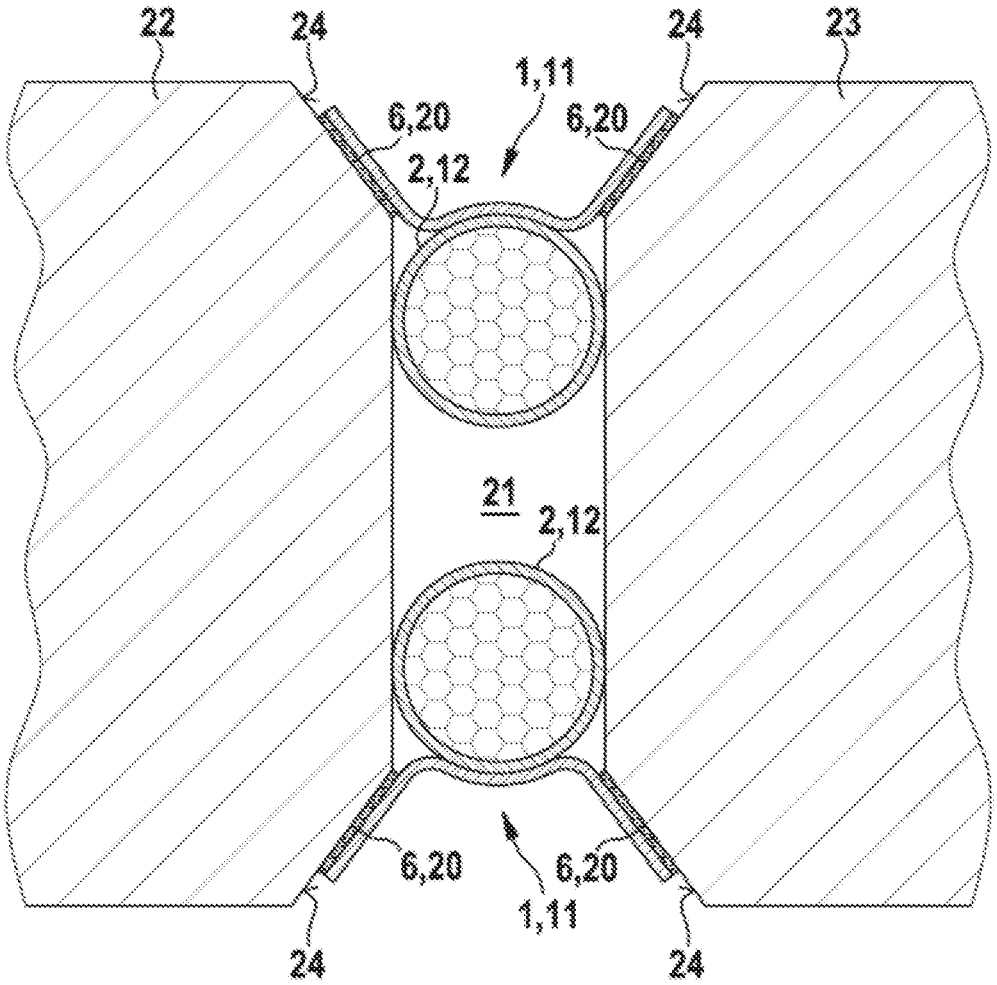
FIG. 3 shows an arrangement of the sealing cord in a joint between two building elements.

FIG. 3 illustrates how one of the foregoing sealing cords 1, 11 is introduced into a joint 21 between two building components 22, 23. In particular, for this purpose, building components 22, 23 may be equipped, at their rims turned toward joint 21 with chamfers 24, onto which adhesive faces 6, 20 are adhesively bonded after introduction of sealing profiles 2, 12 into joint 21. This may be done on both sides or on one side of building components 22, 23.

Figure 4:
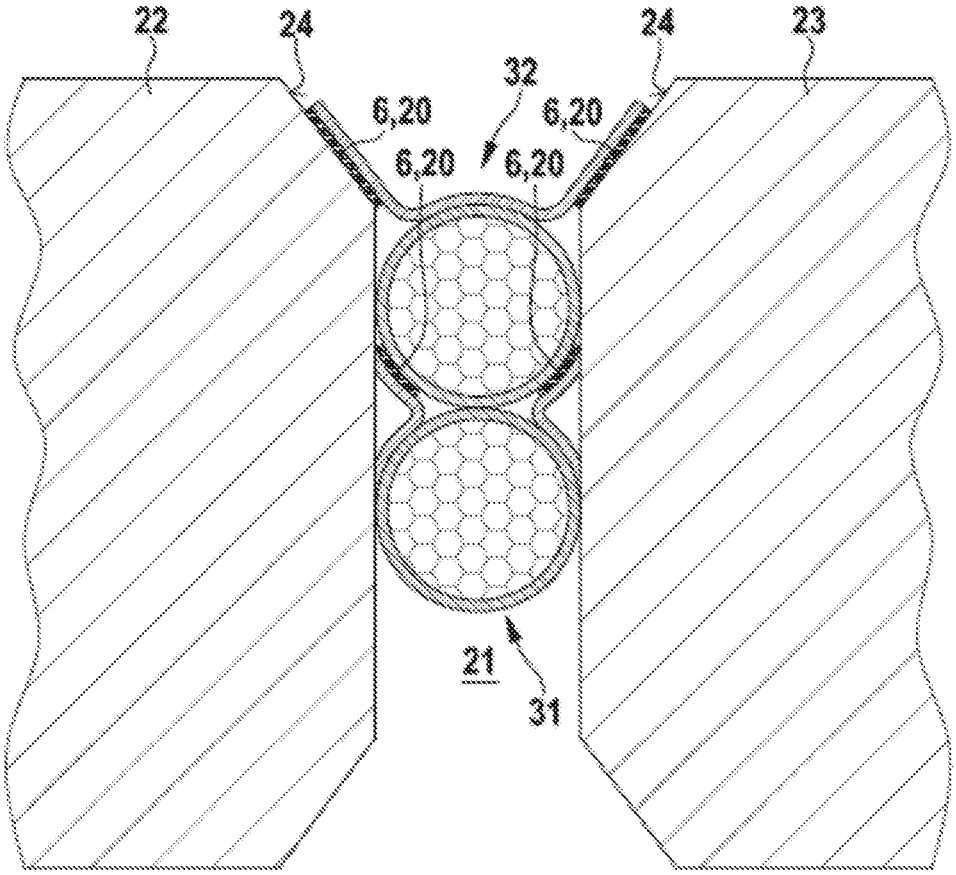
FIG. 4 shows a diagram of a further arrangement of sealing cords in a joint between two building elements.

FIG. 4 illustrates a further embodiment, in which two of the foregoing sealing cords 1, 11 are fastened to one another along their longitudinal extension direction and then inserted into joint 21. For this purpose, lateral portions 51, 52 of sealing cord 1 or the lateral portions, formed as connecting portions 19, of a first sealing cord 31 are placed on sealing profile 2, 12 of a corresponding second sealing cord 32 and joined thereto, especially by adhesive bonding. Thus two sealing profiles are obtained that contact one another and extend parallel to one another in longitudinal direction. The arrangement of the two sealing profiles is chosen such that it is oriented substantially transversely relative to the extension direction of fastening strip 5 or of fastening film strip 14, so that the entire arrangement can be adhesively bonded onto the building components in the manner described in the foregoing by means of adhesive faces 6, 20 of second sealing cord 32.

The invention claimed is:

1. A sealing cord for sealing a joint between two building elements, comprising:

a sealing profile having a compressible sealing material;

lateral portions, which extend from the sealing profile in several directions transversely relative to a longitudinal direction;

a fastener on an exposed side of each of the lateral portions extending from the sealing profile, the exposed side of each of the lateral portions to couple the sealing profile to the two building elements; and further comprising a first firm strip on a first side of the compressible sealing material, and a second film strip on a second side of the compressible sealing material, wherein the first film strip joins the second film strip at rim regions on respective sides of the sealing profile.

2. The sealing cord according to claim 1, wherein the fastener comprises an adhesive face.

3. The sealing cord according to claim 2, wherein the adhesive face is protected with a protective strip.

4. The sealing cord according to claim 1, wherein the sealing profile is provided with a film tube filled with compressible foam material.

5. The sealing cord according to claim 1, wherein the sealing profile has a round, oval or polygonal cross section.

6. The sealing cord according to claim 1, wherein the sealing profile comprises a chamber with a film tube.

7. The sealing cord according to claim 1, wherein each of the lateral portions comprises a fastening strip on which the sealing profile is affixed along a longitudinal direction, the sealing profile extending from the fastening strip in one direction.

8. The sealing cord according to claim 7, wherein the fastener is coupled to a side of the sealing profile.

9. The sealing cord according to claim 1, wherein the sealing profile comprises a fastening film strip and an envelope film strip, wherein a chamber is between the fastening film strip and the envelope film strip, and wherein at least one of the fastening film strip and the envelope film strip comprises a bulging portion.

10. The sealing cord according to claim 9, wherein the envelope film strip comprises rims in or coupled to rim regions of the fastening film strip, and wherein the rim regions adjoin the bulging portion of the at least one of the fastening film strip and the envelope film strip.

11. The sealing cord according to claim 10, wherein the fastening film strip has a first bulging portion and the envelope film strip has a second bulging portions, and wherein the first and second bulging portions have different depths.

12. An arrangement having a joint between two building elements and one or more sealing cords according to claim 1, wherein the lateral portions are affixed on respective surfaces of the building elements turned toward the joint, so that the sealing profile projects into the joint.

13. The arrangement according to claim 12, wherein a first and a second sealing cord are disposed alongside one another in such a way that they run in parallel with respect to their longitudinal directions, and wherein an arrangement direction of a first and of a second sealing cord is substantially perpendicular to an extension direction of the fastening strip of the sealing cord or to an extension of the fastening film strip of the sealing cord.

14. The sealing cord according to claim 1, wherein a first portion of the compressible sealing material is above the lateral portions, and a second portion of the compressible sealing material is below the lateral portions.

15. The sealing cord according to claim 14, wherein the first portion of the compressible sealing material has a first size, the second portion of compressible sealing material has a second size, and the first size is different from the second size.

16. The sealing cord according to claim 1, wherein the first film strip is joined to the second film strip at Y-shaped regions on the respective sides of the sealing profile.

* * * * *